US010227197B2

(12) United States Patent
DeBruler et al.

(10) Patent No.: US 10,227,197 B2
(45) Date of Patent: Mar. 12, 2019

(54) METHOD FOR REDUCING THE EFFECTS OF PARENT ROLL VARIATIONS DURING UNWINDING

(71) Applicant: The Procter & Gamble Company, Cincinnati, OH (US)

(72) Inventors: Jason Lee DeBruler, West Chester, OH (US); Paul Anthony Kawka, Kelso Township, IN (US); Andrew Price Palmer, Lebanon, OH (US)

(73) Assignee: The Procter & Gamble Plaza, Cincinnati, OH (US)

( * ) Notice: Subject to any disclaimer, the term of this patent is extended or adjusted under 35 U.S.C. 154(b) by 763 days.

(21) Appl. No.: 13/968,773

(22) Filed: Aug. 16, 2013

(65) Prior Publication Data

US 2015/0048198 A1 Feb. 19, 2015

(51) Int. Cl.
*B65H 23/04* (2006.01)
*B65H 23/182* (2006.01)

(52) U.S. Cl.
CPC ..... *B65H 23/046* (2013.01); *B65H 23/044* (2013.01); *B65H 23/182* (2013.01);
(Continued)

(58) Field of Classification Search
CPC ..... B65H 23/1825; B65H 23/1882; B65H 23/1888; B65H 23/046; B65H 23/044;
(Continued)

(56) References Cited

U.S. PATENT DOCUMENTS 4,912,423 A * 3/1990 Milkovic ..... H03F 1/303 330/255
5,572,433 A 11/1996 Falconer et al.
(Continued)

FOREIGN PATENT DOCUMENTS

EP 2305393 11/2013

OTHER PUBLICATIONS

Barton, A.D., et al., Control of high-speed chain conveyor systems, Dissertation Abstracts International, vol. 61(1C), p. 283 (1999) Abstract.

(Continued)

*Primary Examiner* — Robert E Fennema
*Assistant Examiner* — Jigneshkumar C Patel
(74) *Attorney, Agent, or Firm* — Andrew J. Hagerty; Sarah M. DeCristofaro

(57) ABSTRACT

A method for reducing the effects of variations in an unwinding, convolutely wound roll of web material is disclosed. The method utilizes the steps of: a. selecting a reference objective relating to a downstream operation, b. choosing at least one feedback device correlated to the reference objective, c. collecting process data from the at least one feedback device at different positions within a time-varying operation cycle for at least one operation cycle at a learning speed, d. calculating an error as the difference between the collected process data from step (c) and a reference signal related to the selected reference objective, e. generating a correction signal based upon the calculated error from step (d) and, f. applying the correction signal to the actuator during a succeeding time-varying operation cycle.

20 Claims, 8 Drawing Sheets

(52) U.S. Cl.
CPC .... *B65H 2511/16* (2013.01); *B65H 2511/166* (2013.01); *B65H 2557/24* (2013.01); *B65H 2557/2423* (2013.01); *B65H 2557/266* (2013.01); *B65H 2601/1231* (2013.01); *B65H 2801/84* (2013.01)

(58) Field of Classification Search
CPC ..... B65H 23/182; B65H 2511/16; B65H 2511/166; B65H 2557/24; B65H 2557/2423; B65H 2557/266; B65H 2557/1231; B65H 2801/84
USPC ..... 700/122
See application file for complete search history.

(56) References Cited

U.S. PATENT DOCUMENTS 5,584,244 A * 12/1996 Klingler ..... B41F 33/16 101/144
5,643,396 A * 7/1997 Rajala ..... A61F 13/15593 156/361
6,317,637 B1 11/2001 Limroth
6,444,064 B1 * 9/2002 Henry ..... B65H 23/1886 156/229
6,584,366 B1 6/2003 Liepold et al.
6,985,789 B2 1/2006 Carlson et al.
6,991,144 B2 1/2006 Franz et al.
7,070,141 B2 7/2006 Paanasalo
7,847,496 B2 12/2010 Bui et al.
8,195,323 B2 6/2012 Simone
8,244,393 B2 8/2012 McLaughlin et al.
2005/0125180 A1 * 6/2005 Miller ..... A61F 13/15723 702/94
2005/0167460 A1 * 8/2005 Franz ..... B65H 23/044 226/24
2008/0228292 A1 * 9/2008 Reddy ..... G05B 21/02 700/44
2009/0228119 A1 9/2009 Owens et al.
2011/0217090 A1 9/2011 Yamamoto et al.
2011/0307082 A1 12/2011 Schultze et al.
2013/0052293 A1 * 2/2013 Weinhold ..... B26D 1/285 425/336

OTHER PUBLICATIONS

Garimella, S.S., et al., Application of Repetitive Control and Iterative Learning Control to Cold Rolling Processes , Dissertation Abstracts International, vol. 56(1B), p. 470. (1994) Abstract.
PCT International Search Report, dated Nov. 24, 2014, 95 pages.

* cited by examiner

METHOD FOR REDUCING THE EFFECTS OF PARENT ROLL VARIATIONS DURING UNWINDING

FIELD OF THE INVENTION

The present invention relates generally to methods for overcoming the problems associated with web tension and feed rate variations during the unwinding of out-of-round parent rolls. More particularly, the present invention relates to a method for reducing variations associated with unwinding out-of-round parent rolls and the associated web speed tension variations while maximizing operating speed throughout the entire unwinding cycle.

BACKGROUND OF THE INVENTION

In the papermaking industry, it is generally known that paper to be converted into a consumer product such as paper towels, bath tissue, facial tissue, and the like is initially manufactured and wound into large, round rolls. In many instances, these rolls, commonly known as parent rolls, may be on the order of 10 feet in diameter and 100 inches across and generally comprise a suitable paper that is convolutely wound about a core. Typically, a converting facility will have a sufficient inventory of parent rolls on hand to be able to meet the expected demand for the paper conversion to products such as paper towels and facial tissue as the paper product(s) are being manufactured.

Because of the compressible nature of the paper used to manufacture products like paper towels, bath tissue, facial tissue, and the like, it is quite common for parent rolls to become out-of-round. Not only the soft nature of the paper, but also the physical size of the parent rolls, the length of time during which the parent rolls are stored, how the parent rolls are stored (e.g., on their end or on their side), and the fact that 'roll grabbers' used to transport these parent rolls clamp the parent roll generally about the circumference all can contribute to this problem. As a result, by the time many parent rolls are placed on an unwind stand for converting, they have changed from the desired cylindrical shape to an other-than-round (e.g., out-of-round) shape.

In extreme cases, parent rolls can become oblong, assume an 'egg-like' shape, or even resemble a flat tire. But, even when the parent roll is only slightly out-of-round, there are considerable problems. In an ideal case, as material is removed from a completely round, convolutely wound parent roll, the feed-rate, web velocity, and tension will generally be consistent. However, process disturbances such as the feed-rate variability, web velocity variability, and tension variability for an out-of-round, convolutely wound parent roll, caused by the shape changes created by the storage and handling of parent rolls, will likely vary the material removal from the ideal web speed of a completely round parent roll depending upon the position and/or radius at the web takeoff point at any moment in time.

If the rotational speed of the parent roll remains substantially constant, the feed-rate, web velocity, and tension of the web material coming off of an out-of-round parent roll will vary during any particular rotational cycle. Naturally, this depends upon the degree to which the parent roll is out-of-round. Since the paper converting equipment downstream of the unwind stand is generally designed to operate based upon the assumption that the feed-rate, web velocity, and tension of web material coming off of a rotating parent roll is generally consistent with the driving speed of the parent roll, web velocity, and/or tension spikes, and/or slackening during the unwinding process can cause significant problems.

While a tension control system is typically associated with the equipment used in a paper converting facility, the rotational speed and the takeoff point radius can be continuously changing in nearly every case. At least to some extent, these process disturbances are unaccounted for by typical tension control systems. It can be dependent upon the degree to which the parent roll is out-of-round and can result in web feed rate variations and corresponding tension spikes and slackening. These problems can be exacerbated by the need for faster unwind speeds to accommodate the need for faster production output.

With an out-of-round parent roll, such process disturbances cause the instantaneous feed-rate, web velocity, and/or tension of the web material to be dependent upon the relationship at any point in time of the radius at the drive point and the radius at the web takeoff point. As previously mentioned, it is known that out-of-round parent rolls may not be perfectly oblong or elliptical but, rather, they may assume a somewhat flattened condition resembling a flat tire, or an oblong or egg-shape, or any other out-of-round shape depending upon many different factors.

Regardless of the exact shape of the parent roll, at least one point in the rotation of the parent roll exists where the feed rate of paper to the line is at a minimum. At this point, the web tension can spike since the feed rate of the web material is at a minimum and is lower than what is expected by the paper converting equipment downstream of the unwind stand. Similarly, there can exist at least one point in the rotation of the parent roll where the feed rate of paper to the line is at a maximum. At this point, the web tension can slacken since the feed rate of the web material can be at a maximum and more than what is expected by the paper converting equipment downstream of the unwind stand. These process disturbances are not conducive to efficiently operating paper converting equipment for manufacturing paper products such as paper towels, bath tissue and the like. A process disturbance, such as a spike in web tension, can even result in a break in the web material requiring a paper converting line to be shut down.

Clearly, there is a need to overcome this problem. Particularly, out-of-round parent rolls create variable web feed rates and corresponding web tension spikes and web tension slackening that have required that the unwind stand and associated paper converting equipment operating downstream thereof be run at a slower speed. In many instances this creates an adverse impact on manufacturing efficiency.

While various efforts have been made in the past to overcome one or more of the foregoing problems with out-of-round parent rolls, there has remained a need to successfully address the problems presented by web feed rate variations and corresponding web tension spikes and web tension slackening.

SUMMARY OF THE INVENTION

While it is known to manufacture products from a web material such as paper towels, bath tissue, facial tissue, and the like, it has remained to provide methods for reducing feed rate variations in the web material when unwinding a parent roll. Embodiments of the present disclosure described in detail herein provide methods having improved features which result in multiple advantages including enhanced reliability and lower manufacturing costs. Such methods not only overcome problems with currently utilized conventional manufacturing operations, but they also make it possible to minimize wasted materials and resources associated with such manufacturing operations. In certain embodiments, the described method can reduce the effects of process disturbances emanating from misshapen parent rolls being unwound for downstream converting.

Generally, the method for reducing the effects of variations in an unwinding, convolutely wound roll of web material, said unwinding being modifiable by an actuator, utilizes the steps of: a. selecting a reference objective relating to a downstream operation, b. choosing at least one feedback device correlated to the reference objective; c. collecting process data from the at least one feedback device at different positions within a time-varying operation cycle for at least one operation cycle at a learning speed; d. calculating an error as the difference between the collected process data from step (c) and a reference signal related to the selected reference objective; e. generating a correction signal based upon the calculated error from step (d); and, f. applying the correction signal to the actuator during a succeeding time-varying operation cycle.

DETAILED DESCRIPTION OF THE INVENTION

In the manufacture of web material products including paper products such as paper towels, bath tissue, facial tissue, and the like, the web material which is to be converted into such products is initially manufactured and convolutely wound into large parent rolls and placed on unwind stands. The embodiments described in detail below provide exemplary, non-limiting examples of methods for reducing the effects of process disturbances such as feed-rate, web velocity, and/or tension in a web material due to variations in the parent roll when unwinding the parent roll for use in a downstream converting operation. In particular, the embodiments described below provide exemplary, non-limiting methods which take into account any out-of-round variations (or characteristics) of the parent roll and make appropriate adjustments to reduce web feed rate, web velocity, and/or tension variations.

Figure 1:
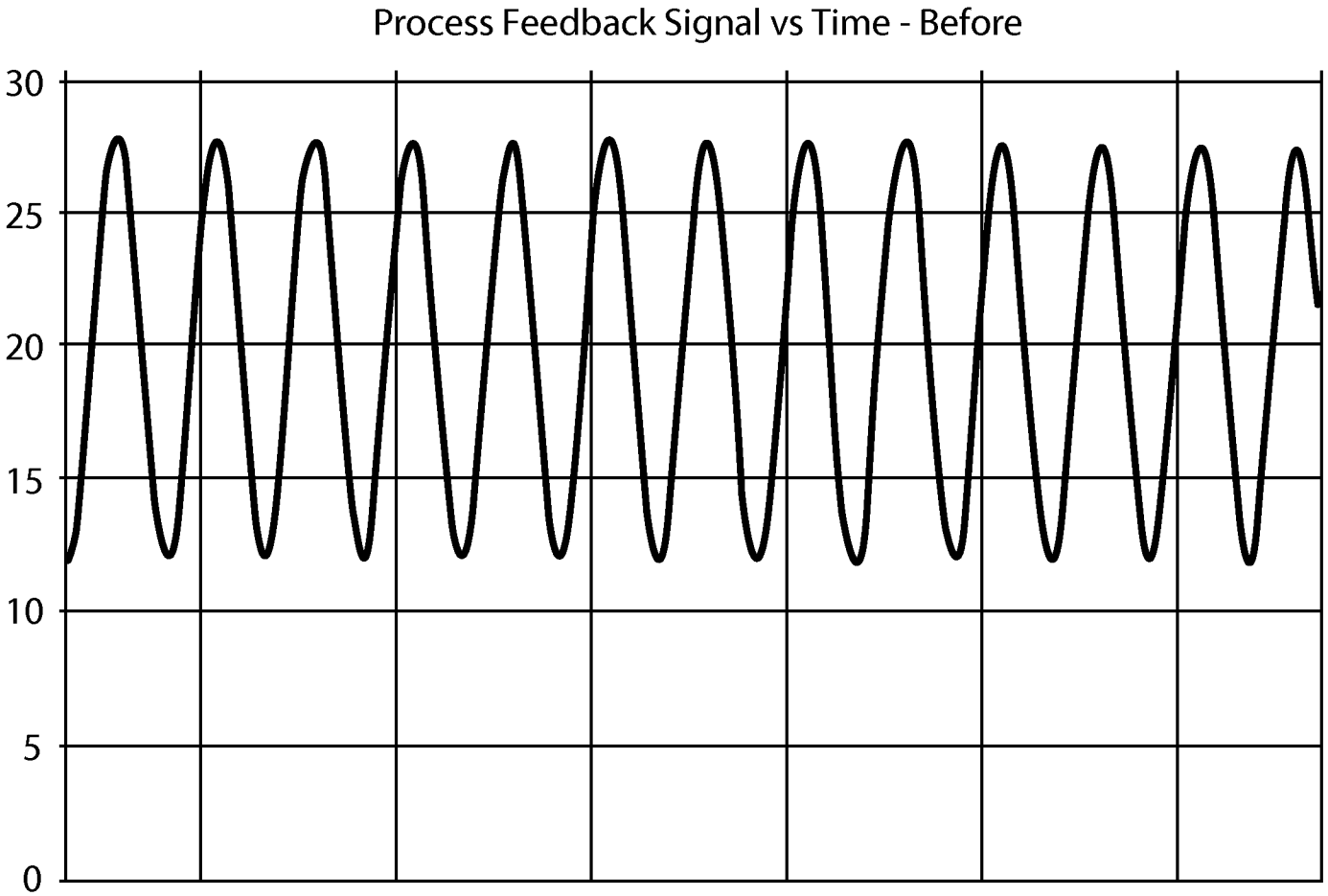
FIG. 1 is a graph showing exemplary variations in a process feedback signal vs. time per operation cycle during the unwinding of an exemplary out-of-round parent roll.

By way of example only, an unwind profile of an out-of-round parent roll may have an exemplary process feedback signal vs. time profile as shown in FIG. 1. As shown, a process feedback signal can vary during each revolution (or cycle) as the convolutely wound product is unwound from the parent roll. The duration of time for the cycle can vary based upon operational conditions experienced such as web tension, web speed, parent roll diameter, and the like.

With regard to these non-limiting examples, the described method makes it possible to effectively and efficiently operate an unwind stand as part of a paper converting operation at maximum operating speed without encountering any significant and/or damaging process disturbances (e.g., deviations in the web feed rate, web velocity, and/or tension, and the like) of the web material as it leaves an out-of-round (e.g., misshapen) parent roll at the web takeoff point.

In the description herein, the out-of-round parent roll can be considered to be generally elliptical in shape and can be contrasted with a perfectly round parent roll. However, any observations, descriptions, illustrations and/or calculations are merely illustrative in nature and are to be considered non-limiting because parent rolls that are out-of round can take virtually any shape depending upon a wide variety of factors. However, the method disclosed and claimed herein is fully capable of reducing feed rate variations in a web material as it is being unwound from a parent roll regardless of the actual cross-sectional shape of the circumference of the parent roll as the parent roll rotates about its longitudinal axis.

Further, while the invention is described in connection with web substrates such as paper, it will be understood and appreciated that it is highly beneficial for use with any web material or any convolutely wound material to be unwound from a roll since the problem of reducing disturbances in a web material induced by variations in a parent roll is not limited to paper substrates. In every instance, one of skill in the art will clearly recognize that it would be highly desirable to maintain a constant or nearly constant feed rate and/or tension of a web coming off of a rotating parent roll to avoid web tensions spikes or slackening.

Figure 2:
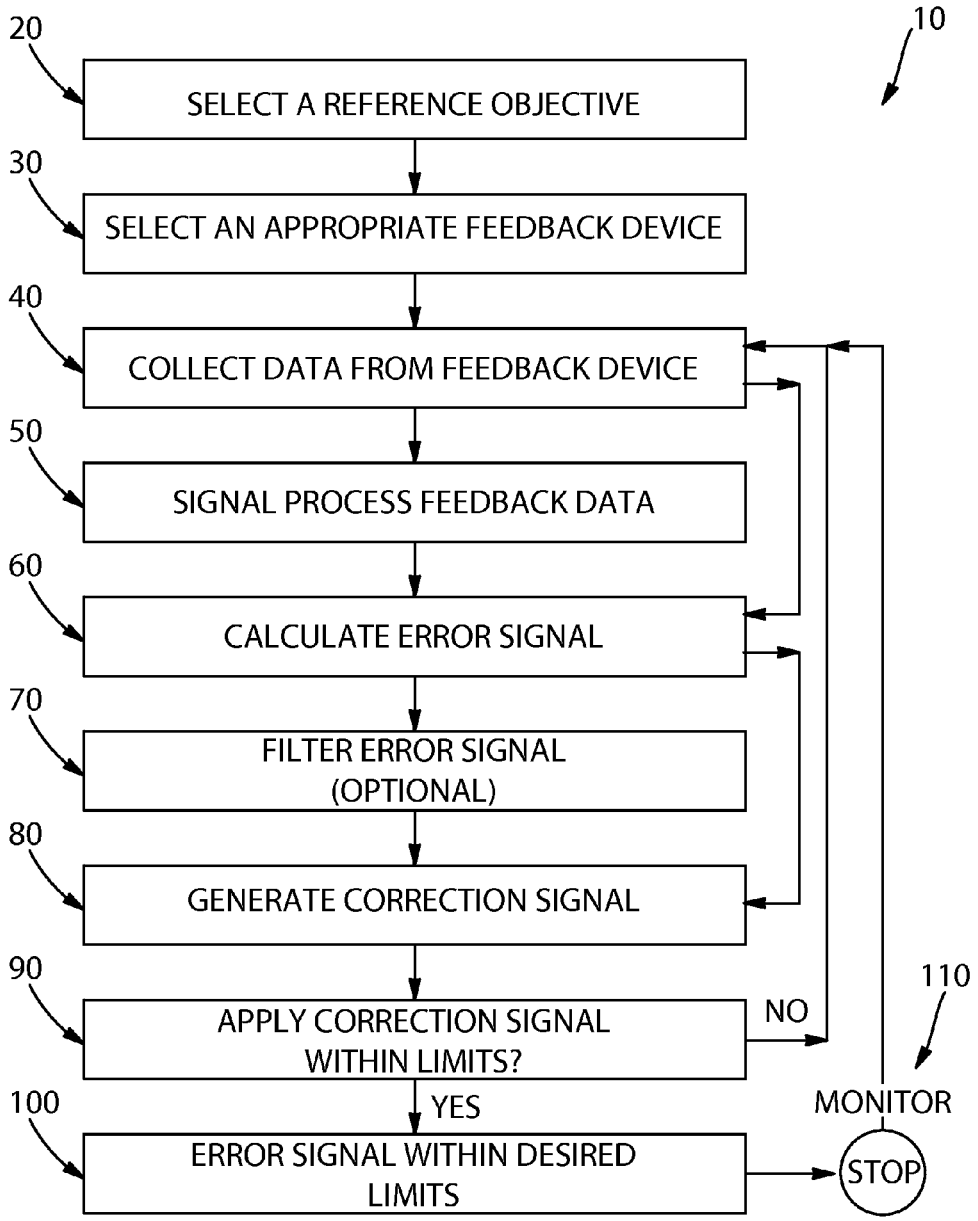
FIG. 2 is a flow diagram illustrating the steps of the method for reducing the effects of parent roll variation of the present disclosure.
Figure 3:
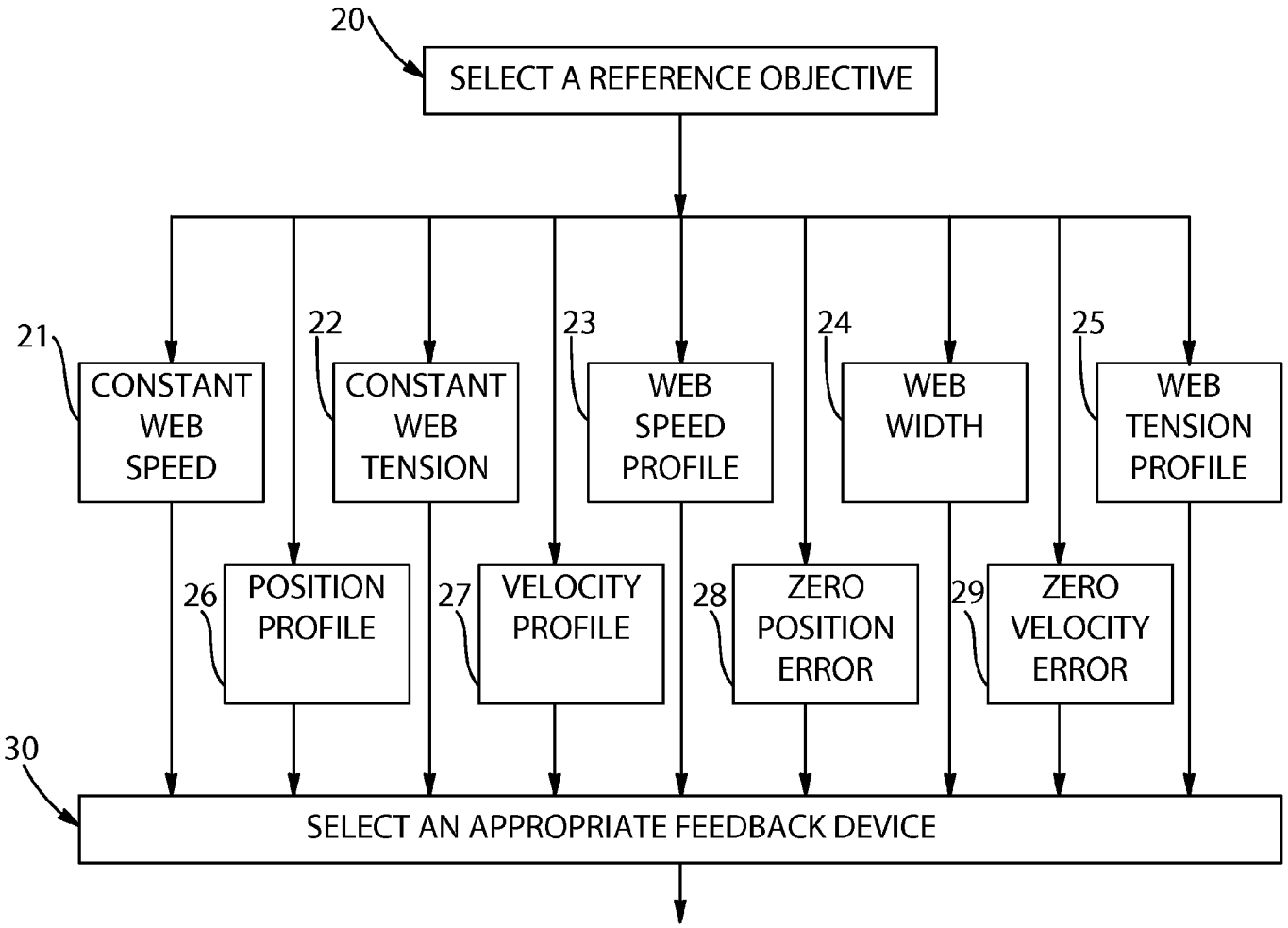
FIG. 3 is a flow diagram detailing the step of selecting a reference objective of the flow diagram of FIG. 2.

FIG. 2 shows, in flow-chart form, the basic steps in the described method 10 for reducing the effects of process disturbances caused by variations in an unwinding, convolutely wound parent roll of web material. First, the method 10 provides for the selection of a reference objective 20 relating, relative, and relevant to a downstream converting operation (process). Referring to FIG. 3, the selected reference objective 20 can be described as the desired (or even a required) characteristic that the unwinding process seeks to monitor for the downstream operation or as an objective that the unwinding process may need to achieve for the downstream operation. This can include, but is clearly not limited to, the goal of providing an unwinding operation that provides unwound material to a downstream converting process at a constant speed, constant tension, varying speed, and/or zero position error as those terms would be understood by one of skill in the art. By way of non-limiting example, the selected reference objective 20 can be the desire to provide the unwinding process with a constant web speed 21. In another application, the selected reference objective 20 may be the desire to provide constant tension 22 at a location within the unwinding process or for a particular downstream process application. Alternatively, the selected reference objective 20 can be the desire to provide a known web speed profile 23. One of skill in the art may desire to provide a downstream converting process with a constant web width 24 through the Poisson effect. Yet still, a selected reference objective 20 could be the desire to unwind the web material according to a known profile such as following a web tension profile 25, web position profile 26, or web velocity profile 27. Further, one of skill in the art may find it desirable to use a selected reference objective 20 relative to the unwinding axis of the parent roll to provide for zero position error 28 or for zero velocity error 29. Additionally, a selected reference objective 20 could be the desire to provide a combination of desired characteristics and/or objectives that the unwinding process may require or need to achieve.

Returning again to FIG. 2, the method described herein next provides for the selection of an appropriate feedback device 30 and a reference signal that correlates to the desired reference objective. With regard to equipment used in practice, they can be of a conventionally known type to provide the necessary data correlating to the desired reference objective. One of skill in the art would understand that an appropriately selected reference signal correlates to the desired reference objective to provide the ideal condition that an operator will attempt to achieve with use of the method described herein. By way of non-limiting example, if the selected reference objective is constant tension, then the reference signal would be a desired constant tension value for the duration of each operation cycle. Alternatively, if the selected reference objective is a constant web speed, the reference signal could be selected as a desired web speed value for the duration of each operation cycle. In any regard, it should be understood that the reference signal does not need to be limited to a constant value for any parameter. Indeed, the reference signal could be provided as a constant value, a profile, or any other signal that is applied during each operation cycle.

Figure 4:
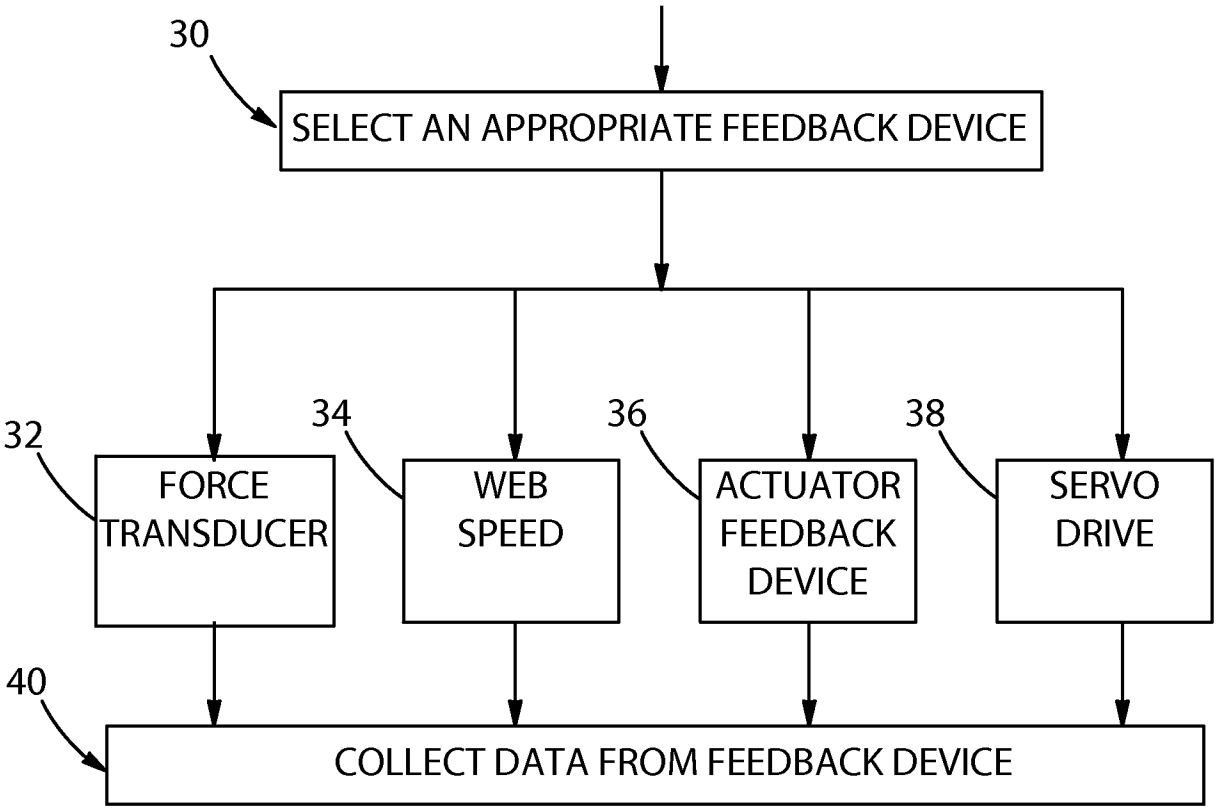
FIG. 4 is a flow diagram detailing the step of selecting an appropriate feedback device of the flow diagram of FIG. 2.

Referring to FIG. 4, by way of non-limiting example, if the selected reference objective 20 would require the measurement of a force in order to correlate to the selected reference objective 20, one of skill in the art would be able to utilize any form of force transducer 32. In other words, an example of appropriately selected feedback device 30 (a force transducer 32) correlates to the desired reference objective (measurement of a force). Exemplary, but non-limiting, force transducers 32 can include tension load cells, strain gauges, and in-process motor torque feedback loops. In use, the latter example could be provided from the driven rolls in an unwinding operation, as they could have a periodic disturbance in torque due to observed changes in web tension.

Alternatively, if the selected reference objective 20 would require the measurement of web speed 34 to correlate to the selected reference objective 20, one of skill in the art would be able to utilize any form of web speed 34 measurement devices. Contact encoders and non-contact web speed 34 sensors are examples of appropriately selected feedback devices 30 that correlate to the desired reference objective (the measurement of web speed 34). It should be understood that non-contact web speed 34 sensors are preferred, as they do not rely on friction between the web and the measurement device to provide an accurate measurement, and there is no wear on manufacturing equipment due to contact with the web. When using non-contact web speed 34 sensors, one of skill in the art would recognize that laser Doppler velocimeters such as the Beta Lasermike (Dayton, Ohio) and LED based optical sensors are suitable such as the COVIDIS manufactured by the Intaction group of Fraba (Hamilton, N.J.).

In this regard, it should be recognized that the selected reference objective 20 could incorporate the use of an actuator feedback device 36 that compares an observed signal to a reference signal. Exemplary actuator feedback devices 36 can be either linear or rotary. One of skill in the art will recognize these actuator feedback devices 36 as encoders and resolvers.

Yet still, the desired reference objective could incorporate the use of servo drives 38. Servo drives 38 can be used for the determination of position and speed errors. Servo drives 38 suitable for use with the present method include, but are not limited to, electronic (e.g., most typical), hydraulic, and pneumatic.

In an exemplary non-limiting embodiment, an actuator suitable for driving (i.e., rotating, unwinding, etc.) a parent roll in accordance with the present method can comprise a servo motor-driven belt in contact with the outer surface of the parent roll. A servo motor can be operatively associated with the belt in any conventional manner as a part of the drive system for controlling the driving speed of the belt. Alternatively, an actuator for driving the parent roll could consist of a center spindle operatively associated with a belt drive and servo motor.

Returning again to FIG. 2, the described method provides for the collection of process data from the selected feedback device 40. The described method prefers that the initial collection of process data from the selected feedback device 40 be at a 'learning speed.' As used herein, 'learning speed' can be defined by the rotational or circumferential speed of the parent roll. As such, 'learning speed' can be a speed slower than production speed. Using this form of 'learning speed' can provide better data and a more complete reduction of effects of the disturbance caused by the variations of the parent roll that is out-of-round. Alternatively, the 'learning speed' can be provided as a routine production speed. Using a 'learning speed' at a production speed may be beneficial by compensating for changes in the shape of the effects of the disturbance throughout the complete unwinding process caused by the variations of the parent roll that is out-of-round. Finally, 'learning speed' may be a speed faster than production speed. The use of a speed faster than production may improve the ability to detect disturbances caused by the variations of the parent roll that is out-of-round. This may be particularly useful in situations considered by one of skill in the art to be ordinarily small and that are amplifiable with increasing speed.

In any regard, the method provides for collection of data from the selected feedback device 40 to be first collected from the selected feedback device 30 at different rotational positions within the revolution of the parent roll for at least one 'operation cycle' at the desired learning speed. For most operations, an operation cycle would be the first complete revolution of the unwinding paper web after it has reached a steady-state speed.

One of skill in the art will recognize that an 'operation cycle' should provide for sufficient machine operation to characterize a periodic disturbance caused by variations in the parent roll over time (also referred to herein as a 'time-varying operation cycle'). This can provide the ability to correlate the pattern of disturbances (if any) to the position within the unwinding cycle. In most instances of conventional web unwinding operations, this could provide for the collection of data over the first complete rotation of the parent roll during an unwind operation. However, the described method envisions that one or more rotations of the material feed roll can also provide sufficient machine operation (i.e., 'operation cycles') to characterize a periodic disturbance caused by the variations in the parent roll (time-varying operation cycles). It should also be recognized that the unwinding operation cycle can change duration continuously in time throughout the manufacturing operation as material is removed from the parent roll. Additionally, it is envisioned that the operation cycle can include all or any part of the 360 machine degrees of a typical machine cycle. It is preferred that an operation cycle include 360 machine degrees. However, in some circumstances it may be feasible to use only 45 machine degrees, or 90 machine degrees, or 180 machine degrees, or 270 machine degrees of a machine cycle.

By way of non-limiting examples, one of skill in the art would recognize that the determination of an operation cycle for a non-center driven unwinding process can utilize an encoder disposed upon a moving core. In such a system, the position of the load in revolutions (or radians) can be used directly. Alternatively, an encoder can be disposed upon the motor driving the center of the parent roll. Here, one of skill in the art can calculate position of the load in revolutions (or radians) through a known mechanical transmission ratio. Preferably, an operation cycle can be determined by one of skill in the art by registering a virtual axis based on registration input from a sensor that sees a signal once per revolution of the parent roll, looking at the parent roll, or the shaft connected to the parent roll. In other words, disturbances caused by variations in the parent roll can vary over time so it can be useful to map a disturbance to a position within the operation cycle over time as the length of the operation cycle changes over time. This can provide continuous mapping of the circumferential position of the parent roll to the virtual axis even as the parent roll decreases in diameter and the mapping varies over time. An algorithm suitable for the latter example of an operation cycle is described in U.S. Pat. No. 8,244,393. Such a process will likely wait for convergence of a virtual axis to an error less than a desired threshold before collecting any process data.

Figure 5:
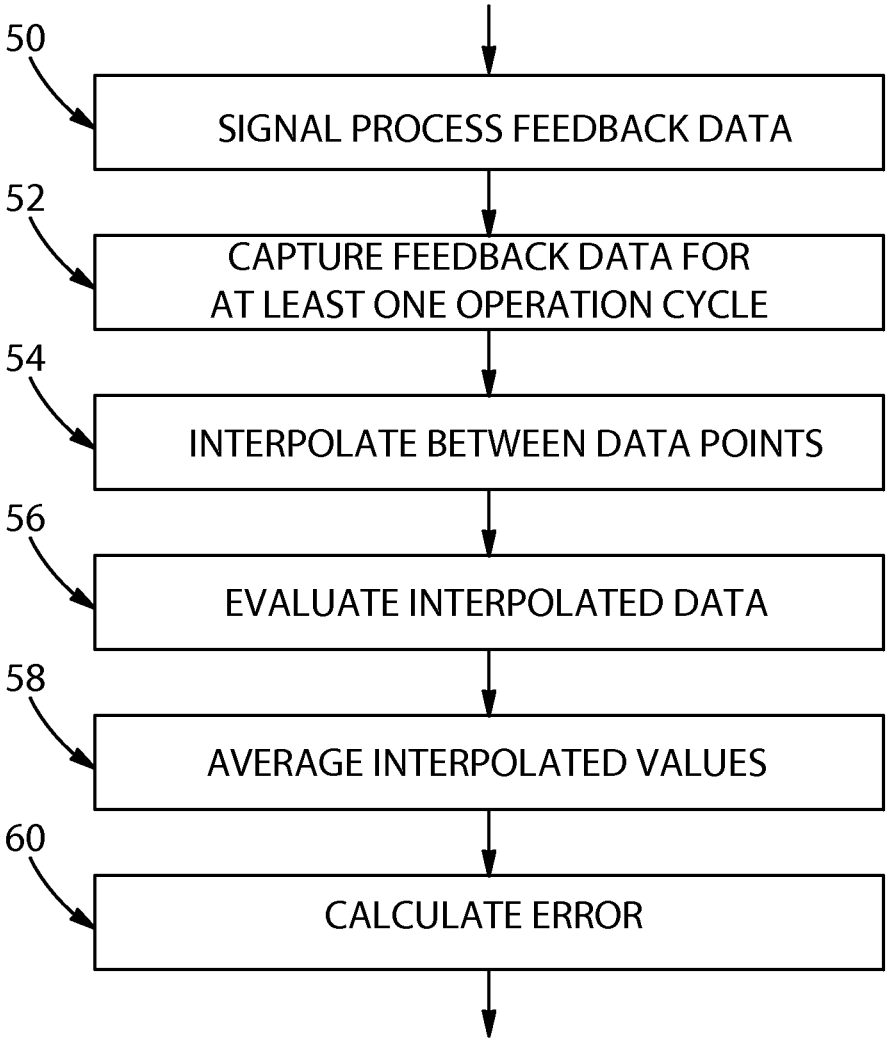
FIG. 5 is a flow diagram detailing the step of signal processing feedback data of the flow diagram of FIG. 2.
Figure 6:
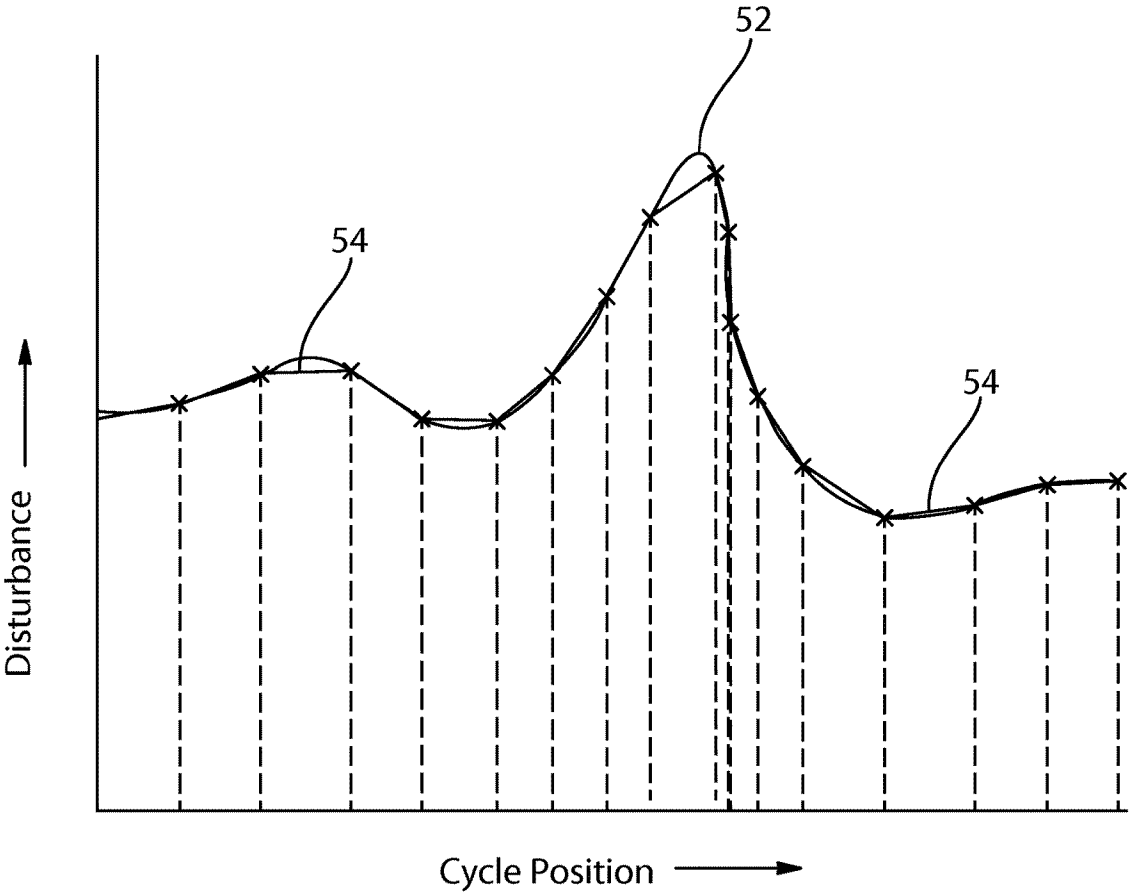
FIG. 6 is a graphic representation of an exemplary signal processing of feedback data according to the present disclosure.

Returning again to FIG. 2, the next step of the described method can optionally utilize signal processing of the data collected from the feedback device 50. As would be appreciated by one of skill in the art, signal processing of the data collected from the feedback device 50 can provide a low noise process output estimate without any filter delays. Referencing FIGS. 5 and 6, signal processing of the data collected from the feedback device 50 can entail the capture of feedback data for at least one operation cycle 52 (e.g., collect a first set of data points related to the disturbance caused by variations in the parent roll during the first revolution of the parent roll). Next, the process provides for the interpolation between consecutive data points for each operation cycle 54. For example, one of skill in the art could interpolate using a best fit curve. Non-limiting examples of such best fit curves can include linear equations, quadratic equations, cubic equations, and the like. Third, the signal processing step can entail the evaluation of the interpolated data points 56 for each operation cycle based on a predetermined number of re-sample points that align with the same cycle position in each operation cycle. Finally, the step of signal processing of the data collected from the feedback device 50 entails averaging the interpolated values 58 (i.e., data points) from the one or more operation cycles at each resample point to create a single disturbance signal. Optionally, the data collected from the feedback device 50 can be filtered for the purpose of removing any operational noise generated during the collection of data from the feedback device step 40. Signal processing of the data collected from the feedback device 50 can be repeated as required.

Returning again to FIG. 1, the process then provides for calculating an error signal 60 as the difference between the averaged, re-sampled process data from the signal processed data collected from the feedback device 50 and the selected reference objective signal 20, at each of the resample points.

Next, optionally, the calculated error signal 60 can be filtered 70 for the purpose of removing any operational noise generated during the collection of data from the feedback device step 40. One skilled in the art of signal processing will recognize that an exemplary, but non-limiting filter can be a zero lag Gaussian low pass digital filter with a typical filter having a cutoff frequency of 0.1. Other filters that could be used include a Butterworth or Chebyshev low pass filter. These exemplary filter options smooth the estimated error signal over the operation cycle so that eventual transformation to an actuator command does not inject measurement noise into the system.

Figure 7:
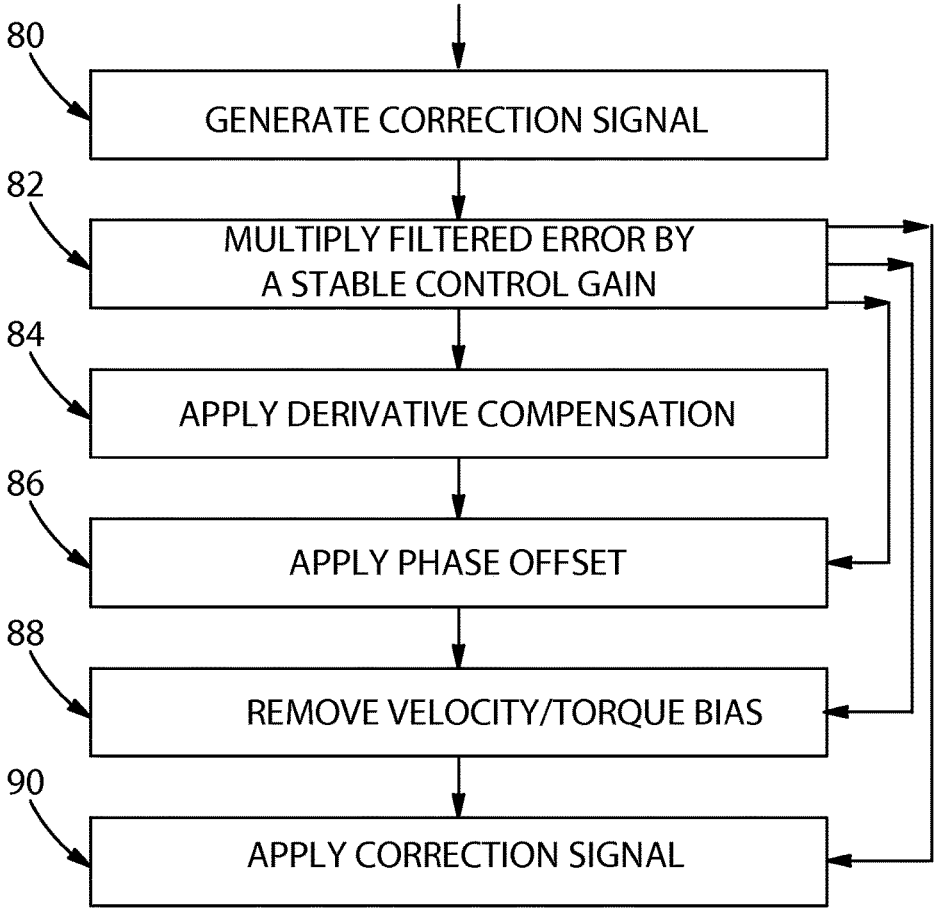
FIG. 7 is a flow diagram detailing the step of generating a correction signal of the flow diagram of FIG. 2; and, FIG. 8 is a graph showing the reduction of the exemplary variations in a process feedback signal vs. time per operation cycle during the unwinding of the exemplary out-of-round parent roll of FIG. 1 with application of the method for reducing the effects of parent roll variation of the present disclosure applied thereto.

Again referencing FIG. 2, the described process next generates a correction signal 80. As shown in FIG. 7, a correction signal commensurate in scope of the present process could be represented by a two step process. First, the filtered error signal 70 is multiplied by a control gain 82 that is stable for the dynamics of the system. Stable in this case signifies that the application of the correction signal does not create an increased variability in the reference objective that is measured. Optionally, derivative compensation 84 (as it is generally understood by those of skill in the art) can be used as an additional additive correction consisting of a second control gain times the difference between the latest filtered error signal and a previous filtered error signal from an earlier operation cycle. Next, optionally, a phase offset can be applied 86 to generate a new additive correction signal. Phase offset refers to a shift between the location of the error within a given cycle and the location in a future operation cycle to which the correction is applied. The application of a phase offset can be utilized to compensate for known sensor delays or process dynamics, such as computational processor delays, transport delays in the electrical signals involved, physical transport delays in the web from the unwind to the location of the feedback device, and combinations thereof. Optionally, the filtered error signal can be subtracted by the mean of the filtered error signal to remove any velocity or torque bias 88 in the correction signal. One of skill in the art may realize that the mean of the feedback variable can be separately controlled by another control loop or mechanical system. Optionally, if the mean of the filtered error signal was removed, it is preferred that application of the correction signal be completed at the beginning of an operation cycle to eliminate any bias in applying the correction signal.

Now referring back to FIG. 2, the described process 10 can next apply the correction signal 90 to the actuator during succeeding (e.g., future) operation cycles by changing the reference speed or torque of the device that drives the parent roll. Other such actuators can be used to control or change the in-feed speed or path length of the web material can also apply the correction signal 90 to future operation cycles.

If it is determined that the error signal between the reference objective and feedback is within a specified and/or desired range of limits, as described infra, then the process can be stopped. These limits could include, but not be limited to, independent maximum and minimum errors or thresholds describing variability such as error variance, error standard deviation, or root mean square (RMS) error. In this instance, it may be prudent for one of skill in the art to continue monitoring 110 the signal from the feedback device 40 to ensure that the feedback signal 20 remains within the desired range of limits of the selected reference objective. If it has been determined by one of skill in the art that the process error signal has grown out of a selected tolerance for the desired range of limits while running at production speed, additional data can be collected from the feedback device 40 and the process described herein can be repeated and/or resumed as required.

As will be appreciated, the method described herein can also utilize any conventional logic device (e.g., an ASIC (Application Specific Integrated Circuit), FPGA (Field Programmable Gate Array) or another similar device in conjunction with a PLC (Programmable Logic Controller), computer, automation controller, or other logic device) to assist with the high speed receiving and processing of data. Further, the PLC system can apply the total correction factor 90 to determine and implement an appropriate operation cycle adjustment by undergoing a suitable initialization, data collection, data processing and control signal output routine.

From the foregoing, it will clearly be appreciated that the method presented by the present disclosure can reduce variations in the feed rate, and hence variations in tension in a web material when unwinding a parent roll having disturbances caused by variations therein to transport the convolutely wound web material away from the parent roll at a web takeoff point.

Figure 8:
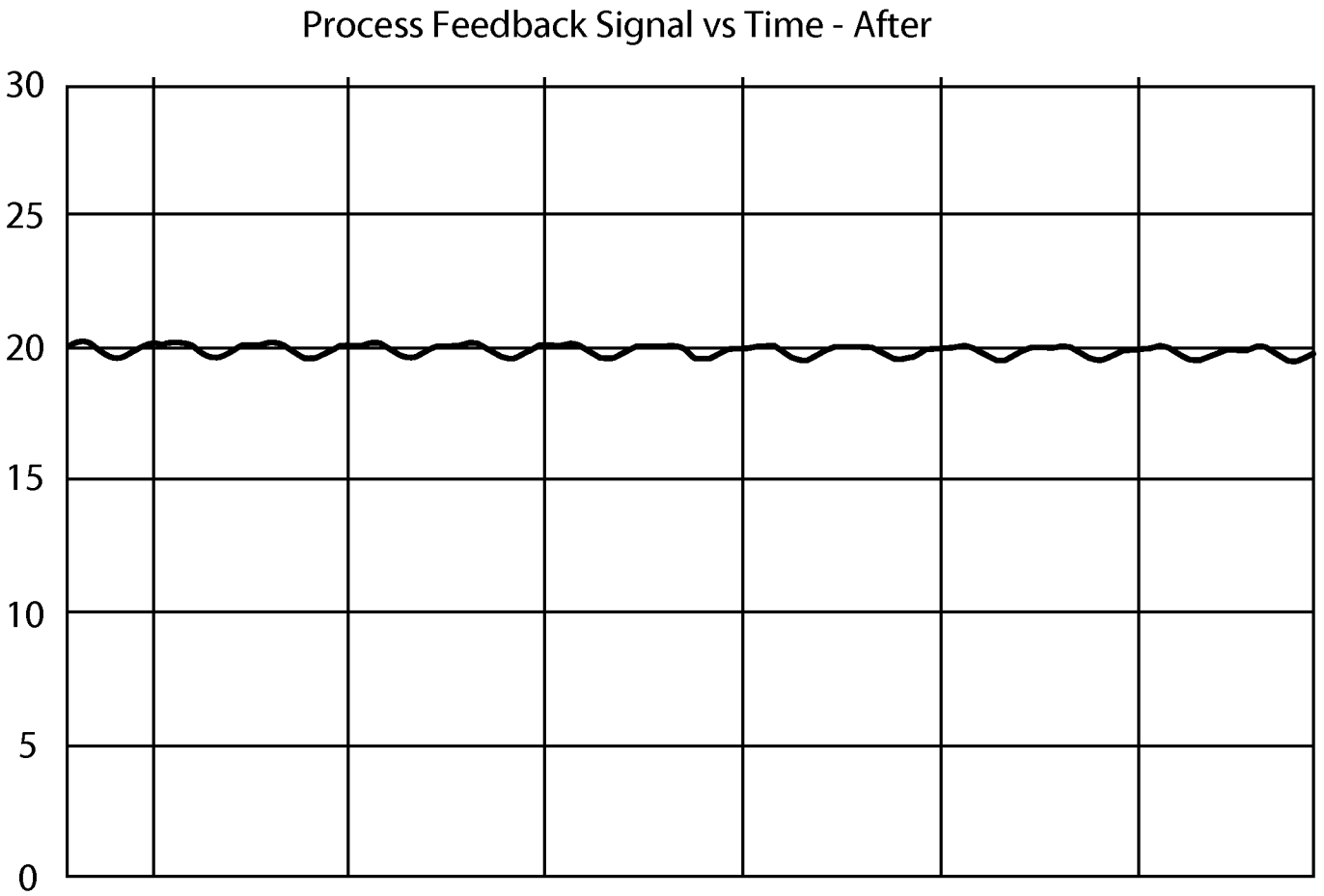

Referring again to FIG. 1, by way of example only, provides an exemplary unwind process feedback signal vs. time profile of an exemplary out-of-round parent roll during unwinding. Any process feedback signal envisioned with respect to the herein described process (e.g., web tension, web speed, and the like) should be considered commensurate in the view shown. As shown, and by example only, the observed tension can vary during each operation cycle as the convolutely wound product is unwound from the parent roll. Application of the aforedescribed method 10 for reducing the effect of parent roll variations can result in the improved process feedback signal vs. time profile as shown in FIG. 8. For the exemplary discussion regarding web tension, as shown in FIG. 8, the improvement in the tension profile after several operation cycles results in an overall reduction in the tension variations observed due to the unwind process and experienced by any downstream converting equipment.

Any dimensions and/or values disclosed herein are not to be understood as being strictly limited to the exact dimensions and/or numerical values recited. Instead, unless otherwise specified, each such dimension and/or value is intended to mean both the recited dimension and/or value and a functionally equivalent range surrounding that dimension or value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for reducing the effects of variations in unwinding a convolutely wound roll of web material, said unwinding being modifiable by an actuator, the method comprising:

a) providing an out-of-round convolutely wound roll of web material and selecting a reference objective relating to a downstream operation;

b) choosing at least one feedback device correlated to said reference objective;

c) collecting process data from said at least one feedback device at different positions within a time-varying operation cycle for at least one operation cycle comprising one revolution of said convolutely wound roll of web material to detect at least one periodic disturbance beginning at a first position within said time-varying operation cycle selected from the group consisting of feed-rate variability, web velocity variability, tension variability, and combinations thereof in the convolutely wound roll at a learning speed;

d) calculating an error as the difference between said collected process data from step (c) and a reference signal related to said selected reference objective;

e) generating a correction signal based upon said calculated error from step (d); and, f) applying said correction signal to said actuator beginning at said first position during a succeeding time-varying operation cycle.

2. The process of claim 1 further comprising the step of signal processing said process data collected in step (c) to provide a low noise process output estimate without adding a delay when applying said correction signal to said succeeding time-varying operation cycle.

3. The process of claim 2 wherein said step of further processing said collected process data collected in step (c) to provide a low noise process output estimate without adding a delay further comprises the steps of:

1) capturing feedback data for said at least one operation cycle;

2) interpolating between successive data points of said captured feedback data for said at least one operation cycle;

3) evaluating successive interpolated data points for at least one successive operation cycle based upon a predetermined number of re-sample points that align with a selected operation cycle position in each of said at least one successive operation cycle; and, 4) averaging said interpolated values from said at least one or more operation cycles at each of said re-sample point to create said low noise process output estimate.

4. The process of claim 3 wherein said step of further processing said collected process data collected in step (c) to provide a low noise process output estimate without any filter delays when applying said correction signal to said succeeding time-varying operation cycle occurs before said step (d).

5. The process of claim 3 wherein said step (2) further comprises the step of interpolating between said successive data points with an equation selected from the group consisting of a best fit line, a quadratic equation, a cubic equation, and combinations thereof.

6. The process of claim 1 wherein said method is repeated for a successive at least one operation cycle.

7. The process of claim 6 wherein said successive at least one operation cycle has a duration in time different from said at least one operation cycle.

8. The process of claim 1 further comprising the step of monitoring variations in said calculated error relative to a selected threshold for said at least one feedback device relative to said selected reference objective and determining whether said calculated error relative to said selected threshold for said at least one feedback device relative to said selected reference objective is within a specified range of limits.

9. The process of claim 8 further comprising the step of, if said calculated error relative to said selected threshold is within said specified range of limits, stopping said step (e).

10. The process of claim 8 further comprising the step of, if said calculated error relative to said selected threshold is not within said specified range of limits, resuming said step (e).

11. The process of claim 1 further comprising the steps of monitoring variations from a second at least one feedback device, determining whether said variations relative to a selected threshold for said second at least one feedback device is within a specified range of limits, and if said variations relative to said selected threshold is within said specified range of limits, stopping said step (e).

12. The process of claim 1 further comprising the steps of monitoring variations from a second at least one feedback device, determining whether said variations relative to a selected threshold for said second at least one feedback device is within a specified range of limits, and if said variations relative to said selected threshold is not within said specified range of limits, resuming said step (e).

13. The process of claim 1 wherein said step (c) further comprises the step of providing said learning speed as a speed less than a production speed.

14. The process of claim 1 wherein said step (c) further comprises the step of providing said learning speed as a speed equal to a production speed.

15. The process of claim 1 wherein said step (c) further comprises the step of providing said learning speed as a speed greater than a production speed.

16. The process of claim 1 wherein said step of generating a correction signal further comprises the steps of:

1) multiplying said calculated error by a control gain; and, 2) applying a phase offset.

17. The process of claim 1 wherein said step of generating a correction signal further comprises the steps of:

1) multiplying said calculated error by a control gain;

2) multiplying a second control gain by the difference between the latest filtered error signal and a previous filtered error signal from an earlier operation cycle; and, 3) applying a phase offset.

18. The process of claim 1 wherein said selected reference objective is selected from the group consisting of constant web speed, constant web tension, a web speed profile, web width, a web tension profile, a position profile, a velocity profile, a zero position error, a zero velocity error, and combinations thereof.

19. The process of claim 1 wherein said step (d) further comprises the step of filtering said calculated error.

20. The process of claim 1 wherein said step (c) further comprises the step of filtering said collected process data.

* * * * *